US005979353A

United States Patent [19]

Børseth

[11] Patent Number: 5,979,353

[45] Date of Patent: Nov. 9, 1999

[54] PRODUCTION/PLATFORM MOORING CONFIGURATION

[75] Inventor: Knut Børseth, Tårnåsen, Norway

[73] Assignee: Petroleum Geo-Services AS, Lysaker, Norway

[21] Appl. No.: 08/825,406

[22] Filed: Mar. 27, 1997

Related U.S. Application Data

[63] Continuation of application No. 08/602,884, Feb. 16, 1996, abandoned.

[51] Int. Cl.[6] ..... B63B 21/24

[52] U.S. Cl. ..... 114/293; 114/230

[58] Field of Search ..... 114/230, 293; 441/3–5

[56] References Cited

U.S. PATENT DOCUMENTS

| | | | |
|---|---|---|---|
| 3,138,135 | 6/1964 | Langer | 114/230 |
| 3,934,531 | 1/1976 | Allen | 114/63 |
| 4,372,240 | 2/1983 | Michael | 114/56 |
| 4,509,448 | 4/1985 | Pease et al. | 114/293 |
| 4,892,495 | 1/1990 | Svensen | 114/230 |
| 5,044,297 | 9/1991 | de Baan et al. | 114/293 |
| 5,054,415 | 10/1991 | Marshall | 114/230 |
| 5,159,891 | 11/1992 | Lohr et al. | 114/293 |
| 5,421,676 | 6/1995 | Wybro et al. . | |

OTHER PUBLICATIONS

Engstrand et al. "Smaller Production System Allowed by Mooring Network," Offshore, Aug. 1994, pp. 74–77.

*Primary Examiner*—Jesus D. Sotelo

*Attorney, Agent, or Firm*—Gordon Arnold; William Beard

[57] ABSTRACT

A system comprising: a mooring bridle, wherein the mooring bridle is installed below the wave zone of the sea and wherein the bridle is attached to a first vessel; and vessel lines which attach a second vessel to the mooring bridle. A line comprising: an anchor which is attached to the sea floor; an anchor line comprising an upper end and a lower end wherein the lower end is connected to the anchor; an anchor line buoy which is attached to the upper end of the anchor line; and a vessel line comprising an upper end and a lower end wherein the lower end attaches to the buoy and the upper end attaches to the vessel. A system comprising: a first mooring line; and a second mooring line, wherein the first and second mooring lines each comprise: an anchor which is attached to the sea floor; an anchor line comprising an upper end and a lower end wherein the lower end is connected to the anchor; an anchor line buoy attached to the upper end of the anchor line; and a vessel line comprising an upper end and a lower end wherein the lower end is attached to the buoy and the upper end is attached to the vessel, wherein the first and second mooring lines are placed on opposite sides of the vessel so that the net horizontal force on the vessel is zero. A system comprising: a first mooring bridle; first vessel lines which attach the first vessel to the first mooring bridle; a second mooring bridle; and second vessel lines which attach the second vessel to the second mooring bridle, wherein the first and second mooring bridle are connected.

18 Claims, 6 Drawing Sheets

PRODUCTION/PLATFORM MOORING CONFIGURATION

This application is a continuation of application Ser. No. 08/602,884, filed Feb. 16, 1996 now abandoned.

FIELD OF THE INVENTION

This invention relates to systems and methods for mooring deep water, mineral production, tension-leg platform (TLP) and tender vessels.

BACKGROUND OF THE INVENTION

Recently, relatively smaller platforms have been developed for deep sea operations where marginal production does not merit the use of a full scale tension-leg platform (TLP). These marginal platforms use tension-leg mooring, like conventional tension-leg platforms, but comprise smaller floatation structures. Tension-leg mooring typically comprises rigid, single-piece tendons for anchoring the structure to the sea floor, like that disclosed in *Monopod TLP Improves Deepwater Economics,* PETROLEUM ENGINEER INTERNATIONAL (January 1993), incorporated herein by reference.

It is desirable to use the TLP as a production platform, however, the weight and cost of the TLP platform increase significantly with increasing water depth and payload. Monohull vessels provide greater capacities, but they can hardly support the great weight of the risers which transport minerals from wells on the sea floor when disconnect from the operating site is required. Therefore, it is desirable to use a small riser wellhead TLP platform to suspend the risers and support the wellheads, and a disconnectable tender vessel to receive, process and export the produced minerals. The well streams will be chocked and manifolded on the TLP riser platform.

Close mooring of the TLP riser platform and the production tender vessel allows for light weight flexible hoses to be used to transport the minerals. However, as the two vessels are brought into close proximity so that minerals can be transported to and from the TLP to the tender vessel, environmental loads induce excessive displacements on the two vessels and large loads on the transfer system.

Most mooring systems are heavy for large water depths and rough environments so that they require larger production and tender vessels. In marginal deep sea production, larger vessels are not economical. Previously, mooring systems have been provided for single vessels. For example, U.S. Pat. No. 5,045,415, issued to Marshall on Oct. 8, 1991, incorporated herein by reference, discloses a mooring bridle. The reference also suggests that multiple vessels may be moored within the same mooring bridle. But, in order to moor vessels relative to each other so that minerals may be transferred between by light weight, flexible systems, these prior systems require a significant number of mooring lines which increases the overall weight of the system.

Therefore, there is a need for a mooring system of two vessels which stabilizes the two vessels relative to each other without excessive loading the vessels.

SUMMARY OF THE INVENTION

An object of the present invention is to address the weight and stability problems by a mooring bridle system which incorporates the TLP directly into the bridle so that the tender vessel alone may be positioned in the center of the bridle.

According to one aspect of the present invention, there is provided a system comprising: a mooring bridle, wherein the mooring bridle is installed below the wave zone of the sea and wherein the bridle is attached to a first vessel; and vessel lines which attach a second vessel to the mooring bridle.

According to another aspect of the present invention, there is provided a line comprising: an anchor which is attached to the sea floor; an anchor line comprising an upper end and a lower end wherein the lower end is connected to the anchor; an anchor line buoy which is attached to the upper end of the anchor line; and a vessel line comprising an upper end and a lower end wherein the lower end attaches to the buoy and the upper end attaches to the vessel.

According to a further aspect of the invention, there is provided a system comprising: a first mooring line; and a second mooring line, wherein the first and second mooring lines each comprise: an anchor which is attached to the sea floor; an anchor line comprising an upper end and a lower end wherein the lower end is connected to the anchor; an anchor line buoy attached to the upper end of the anchor line; and a vessel line comprising an upper end and a lower end wherein the lower end is attached to the buoy and the upper end is attached to the vessel, wherein the first and second mooring lines are placed on opposite sides of the vessel so that the net horizontal force on the vessel is zero.

According to a still further aspect of the present invention, there is provided a system comprising: a first mooring bridle; first vessel lines which attach the first vessel to the first mooring bridle; a second mooring bridle; and second vessel lines which attach the second vessel to the second mooring bridle, wherein the first and second mooring bridle are connected.

BRIEF DESCRIPTION OF THE DRAWING

The present invention is better understood by reading the following description of nonlimitative embodiments with reference to the attached drawings, wherein like parts in each of the several figures are identified by the same reference character, which are briefly described as follows.

It is to be noted, however, that the appended drawings illustrate only typical embodiments of the invention and are therefore not to be considered a limitation of the scope of the invention which includes other equally effective embodiments.

DETAILED DESCRIPTION OF THE INVENTION

Figure 1:
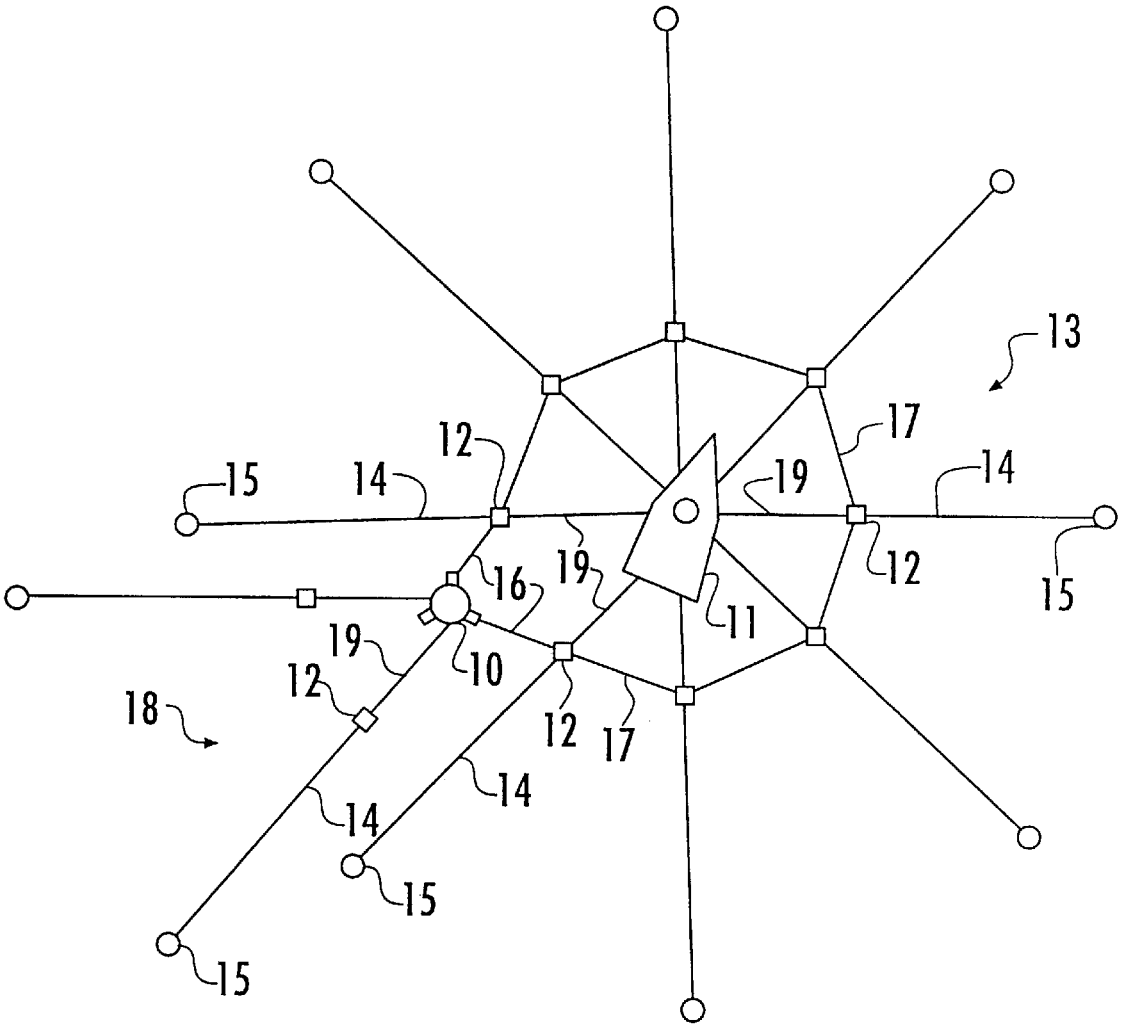
FIG. 1 is top view of an embodiment of the invention.

Referring to FIG. 1, a top view of an embodiment of the invention is shown. TLP 10 is moored to tender vessel 11 by mooring bridle 13. The mooring bridle 13 comprises anchor line buoys 12, anchor lines 14, bridle lines 17 and anchors 15. In this particular embodiment, eight of each elements are used to construct the mooring bridle, but other embodiments comprising any number of elements may be constructed. The anchor line buoys 12 support the weight of the anchor lines 14 so that the top of the mooring bridle 13 is located below the sea wave zone. The tender vessel 11 is positioned in the middle of the mooring bridle 13 and held there by vessel lines 19. A turret may be used to connect the vessel lines 19 to the vessel. Also the turret may be buoyed so that the vessel lines 19 will remain at the surface when the tender vessel is disconnected from the turret.

The TLP is attached to the bridle 13 via chains 16. The chains 16 extend from the TLP 10 to two adjacent anchor line buoys 12. No bridle line 17 is required between these two adjacent anchor line buoys 12. Opposite to the mooring bridle 13, the TLP 10 is anchored to the sea floor by mooring lines 18. Mooring lines 18 comprise an anchor 15, an anchor line 14, an anchor buoy 12 and a vessel line 19. No bridle lines 17 are required to connect the anchor line buoys 12 of the mooring lines 18.

Figure 2A:
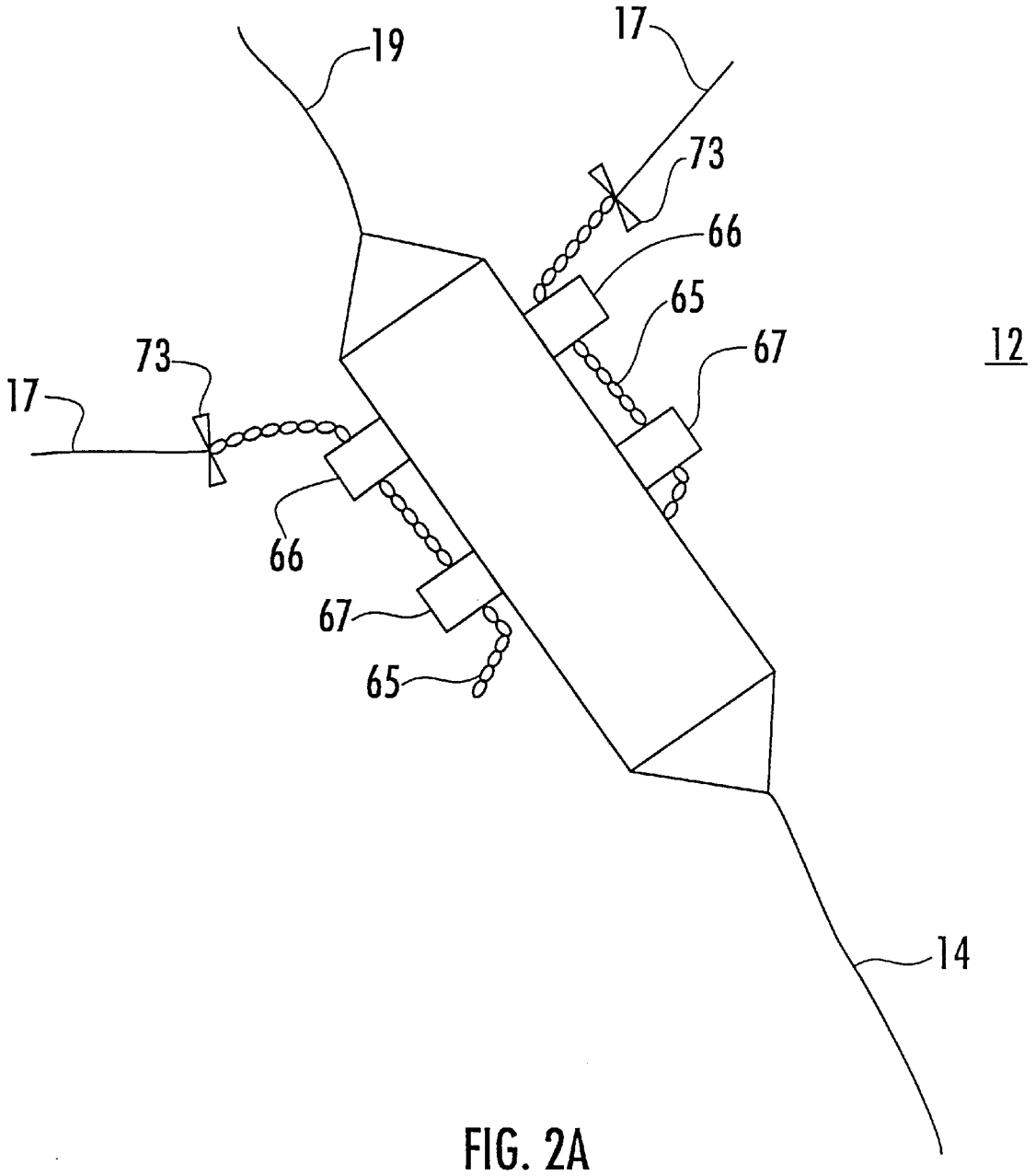
FIG. 2*a* is a plan view of an embodiment of a buoy for a mooring bridle.

Referring to FIG. 2*a,* an embodiment of the anchor line buoy 12 is shown. The vessel line 19 extends from the top of the buoy 12 for attachment to the vessel, while the anchor line 14 extends from the bottom of the buoy 12 for attachment to the anchor. The anchor line buoy 12 may comprise a single sealed chamber filled with gas so that the buoy has positive buoyancy when placed in the sea. Alternatively, the buoy may comprise a series of chambers, each filled with a substance lighter than sea water. Further, the buoy 12 may be filled with a plastic, foam material, or any other material known, so that the buoy will still provide positive buoyancy even if the integrity of the buoy is breached to allow sea water to enter the buoy 12.

Figure 2B:
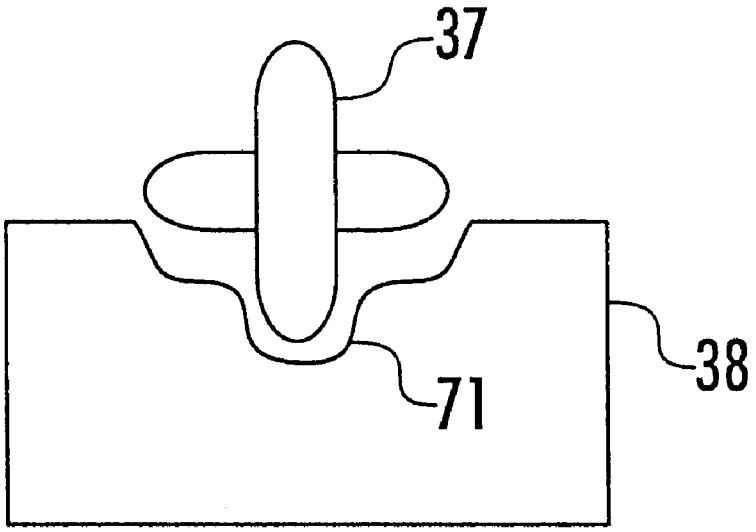
FIG. 2*b* is a side view of an embodiment of a deflector for a buoy of a mooring bridle.
Figure 2C:
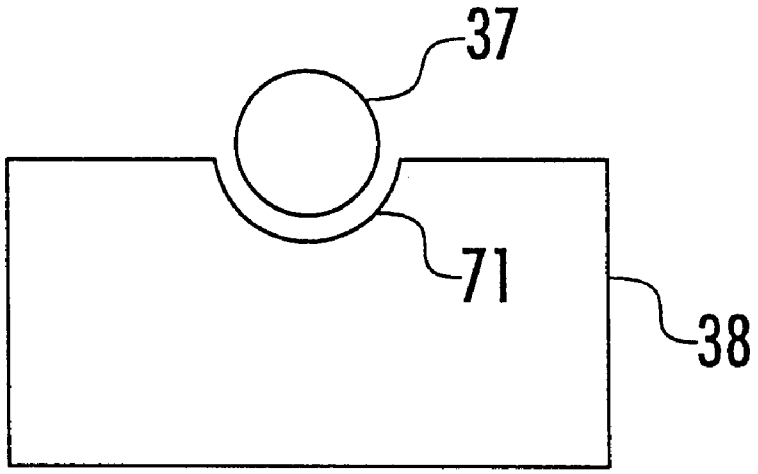
FIG. 2*c* is a side view of an embodiment of a deflector for a buoy of a mooring bridle.

The bridle lines 17 are attached to the buoy 12 by chains 65. In some embodiments, the bridle lines 17 are attached to the chain 65 with a spinner 73 between. The spinner 73 allows the bridle lines 17 to rotate relative to the chain 65. The chains 65 are first deflected down the sides of the buoy 12 by deflectors. These deflectors may comprise pulleys, sliding material, or any other device known. FIG. 2*b,* shows a side view of sliding deflector embodiment. The chain 37 slides within a groove 71 in the deflector 38 which conforms to the shape of the chain. Alternatively, as shown in FIG. 2*c,* a cable 37 may be deflected by the deflector 38, in which case, the groove 71 conforms to the shape of the cable 37. Monoloy material, produced by Smith-Berger of Vancouver, Wash., is a suitable sliding material.

The chains 65 are fastened to the buoy 12 by stoppers 67 and the excess length of chain 65 is allowed to dangle from the stoppers 67. The mooring system is adjusted by pulling the chain 65 through the deflector 66 to impose tension in the bridle lines 17. When a desired tension is obtained, the chain 65 is locked into place by a stopper 67 which is located on the buoy 12. A stopper 67 may comprise two protrusions which straddle a link of the chain 65 so as to catch the next subsequent link in the chain 65. However, automatic stopping systems, known in the art, may also be used. This stopper 67 may comprise a series of stoppers which engage the chain 65 at various positions. Multiple stoppers are used to provide redundancy should one of the stoppers fail. It should be understood that the stoppers may be located anywhere inside or outside the buoy 12, however, placement on the sides of the buoy 12 makes them easily accessible.

Figure 3:
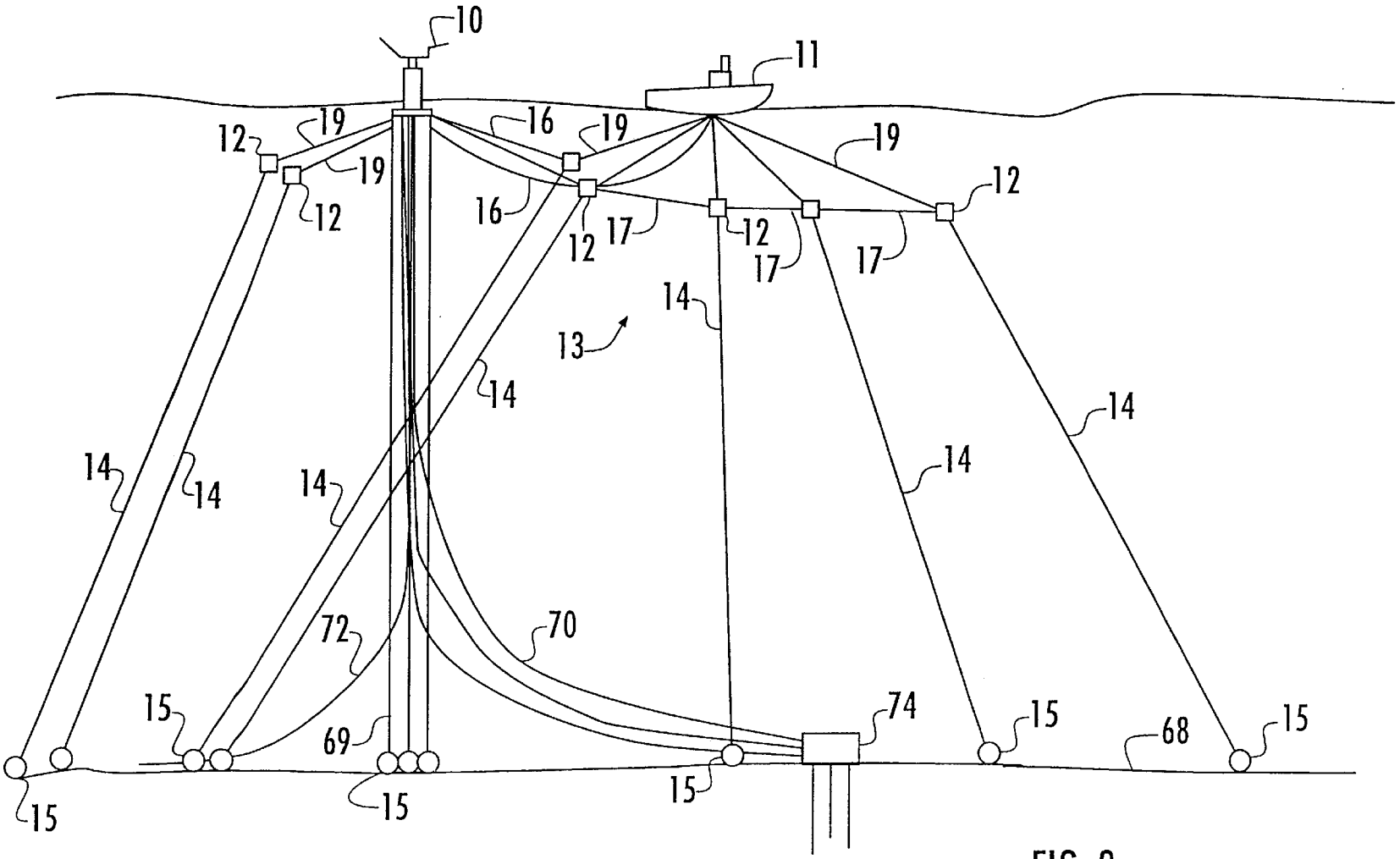
FIG. 3 is a plan view of an embodiment of the invention.

Referring to FIG. 3, a side view of an embodiment of the invention is shown. Anchors are attached to the sea floor 68. Buoys 12 support anchor lines 14 and are connected in some cases by bridle lines 17. The TLP 10 is connected to two adjacent buoys 12 of the mooring bridle 13 by chains 16. The TLP 10 is secured by flexible tendons 69 which are also anchored to the sea floor 68 by anchors 15. Risers 70, for the transportation of minerals, extend from wells 74 to the TLP 10. Export riser 72 extends down from the TLP 10.

The bridle is constructed by positioning each anchor 15, with an anchor line 14 and buoy 12 attached, in its proper location around the mooring site. The anchor lines 14 should be long enough so that the anchor 15 may be suction attached to the sea floor 68 while the buoy floats on the sea surface directly above the anchor 15. Once all of the anchors 15 are in position, the buoys of the bridle 13 may be attached with bridle lines 17. The diameter of the circle formed by the bridle 13 is smaller than the diameter of the circle formed by the anchors on the sea floor. Therefore, as the bridle lines 17 are attached to the buoys 12, the buoys become submerged below the sea surface and the anchor lines 14 become angled toward the mooring site. In one embodiment the depth of the bridle 13, once constructed, is about 30 meters. At this depth, divers are able to assemble the bridle lines 17 to the buoys 12 without difficulty. Further, the radius of the bridle 13 is about 70 meters, so that vessel lines 19 which moor the vessel 11 to the bridle are not unnecessarily lengthy. Shorter vessel lines 19 serve to reduce the mooring load on the vessel 11. The optimum angle of inclination of the anchor lines 14 and the optimum radius of the bridle 13 depend upon the size of the ship to be moored.

Figure 4:
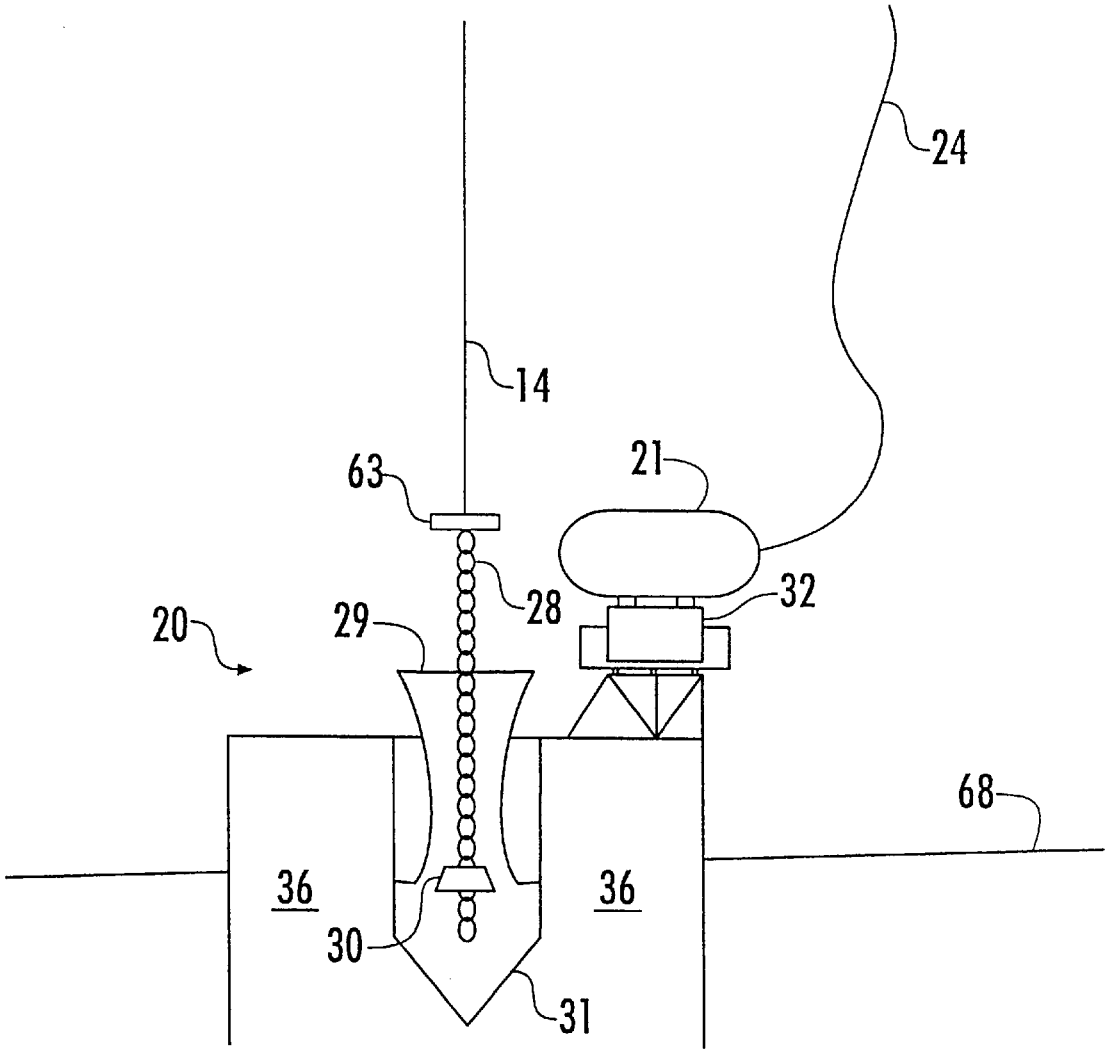
FIG. 4 is a plan view of an embodiment of a suction anchor.

Referring to FIG. 4, one embodiment of the suction anchor is shown. The anchor line 14 is attached to one end of a chain 28. A spinner 63 is used to make the connection so that the anchor line 14 may rotate relative to the chain 28. The other end of the chain 28 is inserted into a funnel 29 located near the top of the anchor 20. Inside the funnel 29, the chain 28 is engaged by a chain stopper 30 which locks it into place. Excess links of the chain 28 are stored in a chain locker 31 below the funnel 29.

In one embodiment, for a TLP weighing about 6000 tons, the chain 28 may comprise 4 inch, oil-rig-quality chain. The tendon may comprise spiral strand wire having a 110 mm diameter. Further, the suction anchor 20 may be made of single steel cylinders with a wall thickness of 20 mm. The total weight of the anchor may range from about 25 tons (3.5 m diameter and 7.5 m long) to about 40 tons (5 m diameter and 11 m long). Optimum anchor size is dependent upon the size of the vessels to be moored and the depth of the sea at the mooring site. See J-L. Colliat, P. Boisard, K. Andersen and K. Schroeder, *Caisson Foundations as Alternative Anchors for Permanent Mooring of a Process Barge Offshore Congo,* OFFSHORE TECHNOLOGY CONFERENCE PROCEEDING, Vol. 2, pgs. 919–929 (May 1995); E. C. Clukey, M. J. Morrison, J. Garnier and J. F. Corte, *The Response of Suction Caissons in Normally Consolidated Clays to Cyclic TLP Loading Conditions,* OFFSHORE TECHNOLOGY CONFERENCE PROCEEDING, Vol. 2, pgs 909–918 (May 1995), both incorporated herein by reference.

Figure 5A:
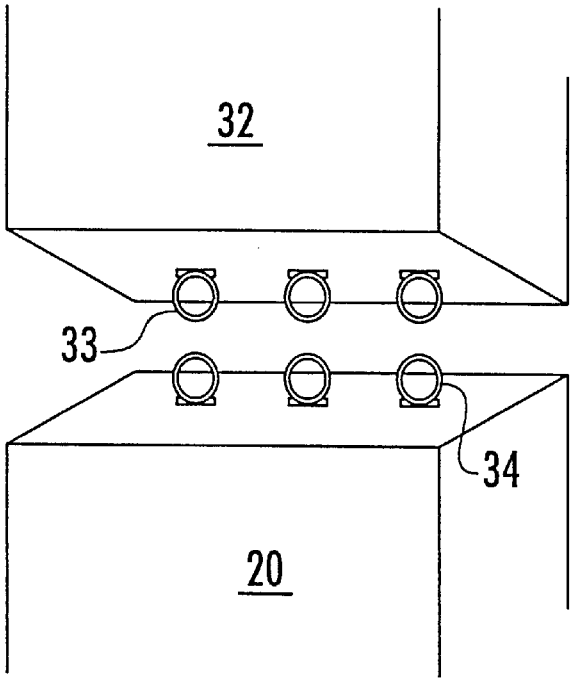
FIG. 5*a* is a plan view of the ROV-POD and anchor.
Figure 5B:
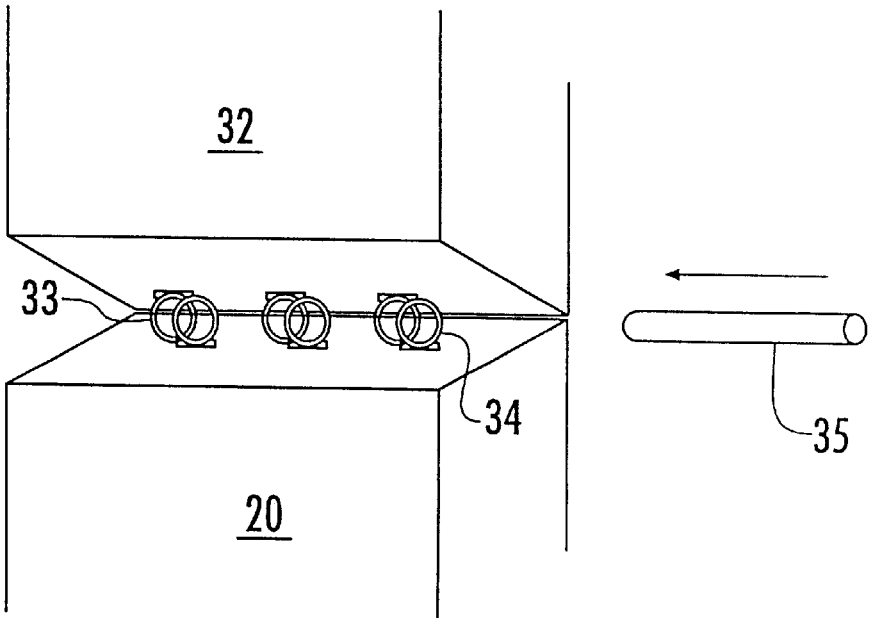
FIG. 5*b* is a plan view of the ROV-POD, anchor and attachment dowel.

The ROV 21 is attached to a ROV pod 32. The ROV pod 32 in turn engages the anchor 20. As shown in FIG. 5*a,* the ROV pod 32 comprises a series of rings 33. The anchor 20 also has a series of rings 34. The devices are connected by bringing the ROV pod 32 in close proximity with the anchor 20 so that rings 33 are placed adjacent to rings 34. As shown in FIG. 5*b,* with the rings juxtaposed, a dowel 35 may be inserted into the rings 33 and 34 to connect the ROV pod 32 to the anchor 20.

Referring again to FIG. 4, the anchor 20 also comprises a series of chambers 36. Each of these chambers are closed on all sides with the exception of the bottom side which is adjacent to the sea floor 68. The anchor is attached to the sea floor 68 by pumping air into the chambers 36 with air supplied by umbilicals 24. Sea water is pushed out of the chambers by the air through one-way valves extending between the chambers and the exterior of the anchor. Once the chambers are filled with air, the air is immediately evacuated to create low pressure inside the chambers. This creates a suction which causes the anchor to become embedded further into the sea floor 68 and to adhere to the sea floor 68. The air may be evacuated by pumps or by allowing the air in the chambers to be exposed to atmospheric pressure at the sea surface via a hose. Multiple chambers 36 provide redundancy to prevent the entire anchor from becoming detached should one of the chambers fail. When the anchor is to be released from the sea floor, air is pumped back into the chambers to increase the pressure.

It is to be noted that the above described embodiments illustrate only typical embodiments of the invention and are therefore not to be considered a limitation of the scope of the invention which includes other equally effective embodiments.

I claim:

1. A system for mooring multiple vessels at sea, the system comprising:

a mooring bridle, wherein said mooring bridle is installed below the wave zone of the sea and wherein said bridle is attached to a first vessel;

vessel lines which attach a second vessel to said mooring bridle; and a turret buoy wherein said vessel lines attach to said turret buoy and said turret buoy attaches to the second vessel.

2. A system as in claim 1 wherein said turret buoy comprises a submerged disconnectable turret buoy which attaches to an internal turret of the second vessel.

3. A system for mooring a first vessel and a second vessel at sea, the system comprising:

a first mooring bridle, comprising:

anchors which are attached to the sea floor;

anchor line buoys which provide buoyancy to the system;

anchor lines which connect said anchor line buoys to said anchors; and bridle lines which connect said anchor line buoys;

first vessel lines which attach the first vessel to said first mooring bridle;

a second mooring bridle;

second vessel lines which attach the second vessel to said second mooring bridle;

wherein said first and second mooring bridle are connected; and a turret wherein said first vessel lines attach to said turret and said turret attaches to the first vessel.

4. A system for mooring a first vessel and a second vessel at sea, the system comprising:

a plurality of anchor lines, anchored at one end to the sea floor;

a bridle line, connected between at least two of the anchor lines;

wherein the plurality of anchor lines and the bridle line define a bridle;

at least two first vessel lines attached to the bridle; and a second vessel attachment location between two of the bridle lines.

5. A system as in claim 4 further comprising an anchor line attached to the second vessel attachment location.

6. A system for mooring a first vessel and a second vessel at sea, the system comprising:

a plurality of anchor lines, anchored at one end to the sea floor, a bridle line connected between at least two of the anchor lines, wherein the plurality of anchor lines and the bridle line define a bridle;

at least two first vessel lines attached to the bridle;

a first buoy attached between the bridle line and a first of the at least two of the anchor lines and a second buoy attached between the bridle line and a second of the at least two anchor lines.

7. A mooring system as in claim 6, wherein said first buoy comprises a common line buoy.

8. A system for mooring multiple vessels at sea, the system comprising:

a mooring bridle;

at least one first vessel line having a first end attached to the mooring bridle and a second end selectively attachable to a first vessel; and at least one second vessel line having a first end attached to the mooring bridle and a second end selectively attachable to a second vessel.

9. A system as claimed in claim 8, further comprising a plurality of first vessel lines and a plurality of second vessel lines.

10. A system as claimed in claim 8, wherein the mooring bridle comprises:

a plurality of anchor lines, anchored at one end to the sea floor; and at least one bridle line connected to at least two of the plurality of anchor lines.

11. A system as claimed in claim 10, further comprising a plurality of second vessel lines, each attached to the mooring bridle proximal separate anchor lines.

12. A system as claimed in claim 10, further comprising:

a plurality of buoys; and each of the plurality of buoys associated with one of the plurality of anchor lines and attached to the associated one of the plurality of anchor lines.

13. A system as claimed in claim 12, further comprising the at least one bridle line connected to at least two of the plurality of anchor lines proximal the attachment of the associated one of the plurality of buoys.

14. A system as claimed in claim 8, further comprising at least one additional-vessel line having a first end attached to the mooring bridle and a second end selectively attachable to an additional vessel.

15. A system for mooring multiple vessels at sea, the system comprising:

a mooring bridle comprising:

a plurality of mooring lines, each comprising:

an anchor attached to the sea floor;

an anchor buoy;

an anchor line having one end attached to the anchor and the opposite end attached to the anchor buoy; and a first vessel line having one end attached to the anchor buoy and an opposite end adapted for selective attachment to a first vessel;

the plurality of mooring lines spaced about a central mooring location; and at least one bridle line, connected to at least two of the plurality of mooring lines;

a second vessel positioned proximal the mooring bridle and offset from the central mooring position;

at least two second vessel lines connecting the second vessel to the mooring bridle.

16. A system as claimed in claim 15, wherein:

the number of bridle lines is equal to at least the number of mooring lines less one; and each bridle line connecting two adjacent anchor buoys.

17. A system as claimed in claim 15, further comprising:

at least one second vessel mooring line, comprising:

an anchor attached to the sea floor;

an anchor buoy;

an anchor line having one end attached to the anchor and the opposite end attached to the anchor buoy; and a second vessel line having one end attached to the anchor buoy and an opposite end attached to the second vessel.

18. A system as claimed in claim 15, wherein the at least two second vessel lines connecting the second vessel to the mooring bridle are each connected to a separate anchor buoy of the mooring bridle.

* * * * *